US008910331B2

(12) United States Patent
Wang et al.

(10) Patent No.: US 8,910,331 B2
(45) Date of Patent: Dec. 16, 2014

(54) CUSHION FOR PREVENTING PRESSURE SORE

(71) Applicants: Shanghai Chuangshi Industry (Group) Co., Ltd., ShangHai (CN); Xi'an Jiatong University, Shaanxi Province (CN)

(72) Inventors: Jue Wang, Shaanxi Province (CN); Litao Fan, ShangHai (CN); Yong You, ShangHai (CN); Sujiao Li, Shaanxi Province (CN); Jianshu Tian, ShangHai (CN); Yuchen Guo, Shaanxi Province (CN); Le Li, ShangHai (CN)

(73) Assignees: Shanghai Chuangshi Industry (Group) Co., Ltd. (CN); Xi'an Jiatong University (CN)

( * ) Notice: Subject to any disclaimer, the term of this patent is extended or adjusted under 35 U.S.C. 154(b) by 0 days.

(21) Appl. No.: 13/939,971

(22) Filed: Jul. 11, 2013

(65) Prior Publication Data

US 2014/0020185 A1 Jan. 23, 2014

(30) Foreign Application Priority Data

Jul. 18, 2012 (CN) ..... 2012 1 0249441

(51) Int. Cl.
*A47C 27/10* (2006.01)
*A47C 7/02* (2006.01)
*A61G 7/057* (2006.01)

(52) U.S. Cl.
CPC ..... *A47C 7/021* (2013.01); *A61G 7/05769* (2013.01)
USPC ..... 5/654; 5/652; 5/655.3; 5/652.1; 5/710; 297/452.41

(58) Field of Classification Search
USPC ..... 5/653, 652, 706, 247, 655.3, 712, 713, 5/710, 652.1, 654; 297/452.41, 452.42, 297/452.47
See application file for complete search history.

(56) References Cited

U.S. PATENT DOCUMENTS 3,982,786 A * 9/1976 Burgin et al. ..... 297/DIG. 3
5,052,068 A 10/1991 Graebe
5,502,855 A 4/1996 Graebe
5,540,484 A * 7/1996 Grundei et al. ..... 297/452.23

(Continued)

*Primary Examiner* — Peter M Cuomo
*Assistant Examiner* — Brittany Wilson
(74) *Attorney, Agent, or Firm* — Schwegman Lundberg & Woessner P.A.

(57) ABSTRACT

The present invention relates to a cushion for preventing pressure sore. The cushion for preventing pressure sore includes an air cell layer, an air passage layer, a base layer, and a plurality of air ducts. The air cell layer has a plurality of air cells; the air cell layer is divided into at least four air cell zones. Air cells in each air cell zone are in communication with each other, but air cells in any two adjacent air cell zones are not in communication with each other; the air passage layer is under the air cell layer and has a plurality of air passages therein. Each air passage is in connection and communication with at least one of the air cell zones; the air passage layer and the air cell layer are disposed on the base layer; an end of each air duct is in communication with a corresponding air passage, and the other end extends out of the cushion and is provided with a joint; and each air duct has a respective valve. The cushion for preventing pressure sore according to the present invention can intermittently exert pressure over human buttocks, thereby effectively preventing pressure sores.

20 Claims, 7 Drawing Sheets

(56) References Cited

U.S. PATENT DOCUMENTS

| | | | | | |
|---|---|---|---|---|---|
| 5,596,781 | A * | 1/1997 | Graebe | ..... | 5/654 |
| 5,613,257 | A * | 3/1997 | Graebe | ..... | 5/654 |
| 5,640,731 | A * | 6/1997 | Toedter | ..... | 5/710 |
| 5,689,845 | A * | 11/1997 | Sobieralski | ..... | 5/654 |
| 5,845,352 | A * | 12/1998 | Matsler et al. | ..... | 5/654 |
| 6,018,832 | A * | 2/2000 | Graebe | ..... | 5/654 |
| 6,623,080 | B2 * | 9/2003 | Clapper | ..... | 297/452.41 |
| 6,687,936 | B2 * | 2/2004 | Graebe et al. | ..... | 5/710 |
| 7,146,664 | B1 * | 12/2006 | Grosvenor | ..... | 5/655.3 |
| 7,434,282 | B2 * | 10/2008 | Fraser et al. | ..... | 5/654 |
| 2006/0085919 | A1 * | 4/2006 | Kramer et al. | ..... | 5/713 |

* cited by examiner

CUSHION FOR PREVENTING PRESSURE SORE

CLAIM OF PRIORITY

This application claims the benefit of priority of Chinese Patent Application Serial Number 201210249441.6, entitled "CUSHION FOR PREVENTING PRESSURE SORE," filed on Jul. 18, 2012, the benefit of priority of which is claimed hereby, and which is incorporated by reference herein in its entirety.

FIELD

The present invention relates to a cushion, and in particular, to a cushion for preventing pressure sore, which is intended for those who need to keep a sitting posture for a long period of time due to illness or injury.

BACKGROUND

Pressure sores are nerve malnutrition and blood circulation disorder caused by long-term pressure or long-term physical and chemical stimulus on local body tissues. Continuous ischemia, anoxia, and malnutrition of the local tissues cause the skin to lose normal functions and lead to festering and necrosis of soft tissues. For instance, sustained vertical pressure, or shear and friction on local tissues may cause pressure sores, and usually, pressure sores are caused by two to three joint forces.

Pressure sores, which are not primary diseases but belong to common clinical complications, are injuries caused by other primary diseases without good care. Pressure sores not only bring considerable physical and mental sufferings and economic burden to the patients but also increase the workload of nurses, and even worse, may lead to secondary infection and trigger septicemia, hence becoming life-threatening.

Most pressure sores can be prevented. However, in practical cases of illness, moisture, heat, age, and obesity all significantly increase the incidence of pressure sores. Therefore, people use various methods to prevent pressure sores. At present, division-type air rings, pressure sores prevention cold liquid cushions or other composite cushions are mainly used to prevent pressure sores, but all these products are flawed in that the cushion continuously exerts pressure on the body, and cannot maintain a stable shell temperature.

In addition, as shown in FIG. 1A and FIG. 1B, US Patent Publication No. 5052068 discloses a contoured cushion, in which a plurality of air cells is disposed on a flexible base 2 thereof. The air cells include a short cell 4, an intermediate cell 6, and a long cell 8 that are organized into an outer zone x and an inner zone y; the air cells of the outer zone x are in communication with each other, the air cells of the inner zone y are in communication with each other, but the air cells of the outer zone x are not in communication with the air cells of the inner zone y. Once the user settles into the cushion, he opens the valves 42 and 44 respectively in communication with the outer zone x and the inner zone y to release the pressure in the air cells of the inner zone x and the outer zone y, thereby adjusting the height of each air cells in the zones, so as to be more in conformance with the shape of human buttocks on the cushion and; hence, the user gets the most comfortable sitting posture and experience.

Moreover, as shown in FIG. 2A and FIG. 2B, US Patent Publication No. 5502855 discloses a cellular cushion, in which a plurality of air cells are disposed on a base 2 thereof. The air cells are organized into four zones, namely, r, s, t, and u; air cells in each zone are in communication, and the four zones can be communicated through a manifold 24. Moreover, communication among the four zones can be cut off by closing separate air ducts 20, 21, 22, and 23. Before the cushion is used, the air cells in the zones are inflated by means of an inflating air valve 26, and at this time, the clip-type hose valve 30 is open, that is, the r, s, t, and u zones are in communication through the manifold 24. After sufficient air is charged into the cushion, the inflating air valve 26 is closed. Then, the user sits on the cushion, and air is slowly released through the inflating air valve 26. As the air is being released, the buttocks of the user sink into the air cells, and when reaching a desired sinking depth, the user closes the inflating air valve 26. In addition, the user can close the separate air ducts 20, 21, 22, and 23 so as to prevent air from flowing among the four zones. This patent has similar advantages as the patent described above, i.e., the user can release air so that the cushion conforms to the shape of body very well, thereby obtaining the most comfortable sitting posture and experience.

When used by those who need to keep a sitting posture for a long time, the cushions in the above two patents can provide very comfortable sitting posture and experience, however pressure is applied to the body continuously, and pressure sores are still very likely to occur.

SUMMARY

In view of the disadvantages of the prior art, the present invention aims at a cushion for preventing pressure sore, which inflates and deflates different air cell zones in an alternating manner, so as to avoid continuously applying pressure on a certain part of the body, thereby reducing the occurrence probability of pressure sores.

To achieve the objective, the technical solution of the present invention is to provide a cushion for preventing pressure sore, which includes: an air cell layer having a plurality of air cells and being divided into at least four air cell zones, air cells in each air cell zone being in communication with each other, but air cells in any two adjacent air cell zones being not in communication with each other; an air passage layer located under the air cell layer and having a plurality of air passages therein, each air passage being in connection and communication with at least one of the air cell zones; a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve.

Preferably, the number of the air passages is less than the number of the air cell zones.

In an embodiment of the present invention, the air cells in the air cell layer are sequentially organized clockwise into four air cell zones with equal areas, namely, an A air cell zone, a B air cell zone, a C air cell zone, and a D air cell zone; the air passage layer has two air passages therein, namely, a first air passage and a second air passage; the first air passage is in connection and communication with the A air cell zone and the C air cell zone, and the second air passage is in connection and communication with the B air cell zone and the D air cell zone.

In another embodiment of the present invention, the air cells in the air cell layer are organized into an A air cell zone, a B air cell zone, a C air cell zone, a D air cell zone, and an E air cell zone as arranged in an array below; the air passage layer has a first air passage, a second air passage, and a third air passage therein; the first air passage is in connection and communication with the A air cell zone and the C air cell zone, the second air passage is in connection and communication with the B air cell zone and the D air cell zone, and the third air passage is in connection and communication with the E air cell zone; the array is shown as follows:

$$\begin{bmatrix} E & E & E & E & E & E & E & E & E & E \\ E & E & E & E & E & E & E & E & E & E \\ A & A & A & A & A & B & B & B & B & B \\ A & A & A & A & A & B & B & B & B & B \\ A & A & A & A & A & B & B & B & B & B \\ A & A & A & A & A & B & B & B & B & B \\ D & D & D & D & D & C & C & C & C & C \\ D & D & D & D & D & C & C & C & C & C \\ D & D & D & D & D & C & C & C & C & C \\ D & D & D & D & D & C & C & C & C & C \end{bmatrix}.$$

In still another embodiment of the present invention, the air cells in the air cell layer are organized into an A1 air cell zone, an A2 air cell zone, an A3 air cell zone, an A4 air cell zone, a B1 air cell zone, a B2 air cell zone, a B3 air cell zone, a B4 air cell zone, a C air cell zone, a D air cell zone, and an E air cell zone as arranged in an array below; the air passage layer has a first air passage, a second air passage, a third air passage, a fourth air passage, and a fifth air passage therein; the first air passage is in connection and communication with the A1, A2, A3, and A4 air cell zones, the second air passage is in connection and communication with the B1, B2, B3, and B4 air cell zones, the third air passage is in connection and communication with the C air cell zone, the fourth air passage is in connection and communication with the D air cell zone, and the fifth air passage is in connection and communication with the E air cell zone; the array is shown as follows:

$$\begin{bmatrix} E & E & E & E & E & E & E & E & E & E \\ E & E & E & E & E & E & E & E & E & E \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & B3 & A3 & A3 & A3 & A3 & A3 \\ B3 & B3 & B3 & B3 & B3 & A3 & A3 & A3 & A3 & A3 \\ A1 & A1 & D & D & D & D & D & D & B1 & B1 \\ A1 & A1 & D & D & D & D & D & D & B1 & B1 \\ A1 & A1 & B2 & B2 & C & C & A2 & A2 & B1 & B1 \\ A1 & B2 & B2 & B2 & C & C & A2 & A2 & A2 & B1 \end{bmatrix}.$$

In still another embodiment of the present invention, the air cells in the air cell layer are organized into an A1 air cell zone, an A2 air cell zone, an A3 air cell zone, a B1 air cell zone, a B2 air cell zone, a B3 air cell zone, a C air cell zone, a D air cell zone, an E air cell zone, and an F air cell zone as arranged in an array below; the air passage layer has a first air passage, a second air passage, a third air passage, a fourth air passage, a fifth air passage, and a sixth air passage therein; the first air passage is in connection and communication with the A1, A2, and A3 air cell zones; the second air passage is in connection and communication with the B1, B2, and B3 air cell zones, the third air passage is in connection and communication with the C air cell zone, the fourth air passage is in connection and communication with the D air cell zone, the fifth air passage is in connection and communication with the E air cell zone, and the sixth air passage is in connection and communication with the F air cell zone; the array is shown as follows:

$$\begin{bmatrix} E & E & E & E & E & E & E & E & E & E \\ E & E & E & E & E & E & E & E & E & E \\ A3 & A3 & A3 & A3 & A3 & B3 & B3 & B3 & B3 & B3 \\ A3 & A3 & A3 & A3 & A3 & B3 & B3 & B3 & B3 & B3 \\ B2 & B2 & B2 & B2 & B2 & A2 & A2 & A2 & A2 & A2 \\ B2 & B2 & B2 & B2 & B2 & A2 & A2 & A2 & A2 & A2 \\ A1 & A1 & C & C & C & D & D & D & B1 & B1 \\ A1 & A1 & C & C & C & D & D & D & B1 & B1 \\ A1 & A1 & C & C & F & F & D & D & B1 & B1 \\ A1 & C & C & C & F & F & D & D & D & B1 \end{bmatrix}.$$

In other embodiments of the present invention, the air cells in the air cell layer are organized into an A1 air cell zone, an A2 air cell zone, an A3 air cell zone, an A4 air cell zone, an A5 air cell zone, a B1 air cell zone, a B2 air cell zone, a B3 air cell zone, a B4 air cell zone, a B5 air cell zone, and a C air cell zone as arranged in an array below; the air passage layer has a first air passage, a second air passage, and a third air passage therein; the first air passage is in connection and communication with the A1, A2, A3, A4, and A5 air cell zones, the second air passage is in connection and communication with the B1, B2, B3, B4, and B5 air cell zones, and the third air passage is in connection and communication with the C air cell zone; the array is shown as follows:

$$\begin{bmatrix} C & C & C & C & C & C & C & C & C & C \\ C & C & C & C & C & C & C & C & C & C \\ B5 & B5 & B5 & B5 & B5 & A5 & A5 & A5 & A5 & A5 \\ B5 & B5 & B5 & B5 & B5 & A5 & A5 & A5 & A5 & A5 \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & B3\backslash A4 & B4/A3 & A3 & A3 & A3 & A3 \\ B3 & A1 & B3 & B3 & B3/A2 & B2\backslash A3 & A3 & A3 & B1 & A3 \\ A1 & A1 & B3 & B3 & A2 & B2 & A3 & A3 & B1 & B1 \\ A1 & B3 & B3 & B3 & A2 & B2 & A3 & A3 & A3 & B1 \end{bmatrix}.$$

Preferably, the plurality of air ducts is disposed in the air passage layer or in the base layer.

Preferably, the cushion for preventing pressure sore further includes an inflating device and a deflating device; the inflating device and the deflating device are connected to the joint of the air ducts.

Preferably, the cushion for preventing pressure sore further includes a control device; the control device is electrically connected to the valve on the air duct, and is electrically connected to the inflating device and the deflating device, so as to control the inflating device to inflate the air duct or control the deflating device to deflate the air duct.

Preferably, each air cell in the air cell layer is a columnar air cell; the columnar air cell includes a columnar outer casing layer and an air cell column disposed in the outer casing layer; the air cell column may be any one or any combination of a spring, a sponge, cotton, and a foam plate; more preferably, the air cell column is directly formed by foaming a sponge, is highly fitting and firm, and meanwhile improves the overall stability of the air cell and helps maintain the shape of the air cell. Moreover, a hydrogel layer is disposed at the top of the air cell column, a sealing layer is disposed between the top of the air cell column and the hydrogel layer, and air is filled in space among the outer casing layer, the air cell column, and the sealing layer. The sealing layer tightly contacts an inner wall of the outer casing layer, so that the directly formed hydrogel does not fall off or leak under the effect of gravity and extrusion of a body.

The top of the outer casing layer is an upwardly protruding cambered surface, which reduces edges and corners and increases a contact area. When the body contacts the arc-shaped hydrogel layer at the top, no discomfort or pains is aroused.

The columnar air cell is shaped into any one of a cylinder, a prism, a cube, a cuboid or a combination thereof.

A cross section of the columnar air cell is shaped into a four-pointed star, and a periphery of the columnar air cell is arc-shaped.

The present invention has following advantages: the air cell layer is divided into different air cell zones in cross distribution, and the pressure of air cells in the air cell zones and the pressure lasting time are controlled so that pressure is intermittently exerted over the buttocks, thereby preventing blood circulation of the skin from being blocked. Furthermore, owing to the hydrogel layer above the air cell columns and the sealing layer between the top of the air cell columns and the hydrogel layer, the columnar air cells are protected from thorough damage, and have multiple protection functions. The hydrogel layer and a constant-temperature phase transition material in the columnar air cells maintain a comfortable temperature at the surface of buttocks of the user, so that the user feels cool and a desirable pressure equalizing effect is generated. Meanwhile, the upwardly protruding arc-shaped hydrogel layer does not have any sharp edges or corners thereon, contributing to a greater contact area, thereby avoiding the problem of concentrated stress caused by the acute angle, and dispersing the load, so that the user does not feel pain during long-time contact. The periphery of the columnar air cell is arc-shaped, which enhances and fully brings out the mechanical strength of the cushion, and improves the fluidity of the plastic melt, thereby facilitating the filling and demolding, eliminating defects such as the concave at the turning part of the wall, and facilitating the machining and thermal treatment of the mold; hence, the service life of mold is improved. The air cell column has a function of maintaining a stable air cell shape, and will not collapse and hence be damaged due to insufficient stability.

DRAWINGS

DETAILED DESCRIPTION OF THE INVENTION

Figure 1A:
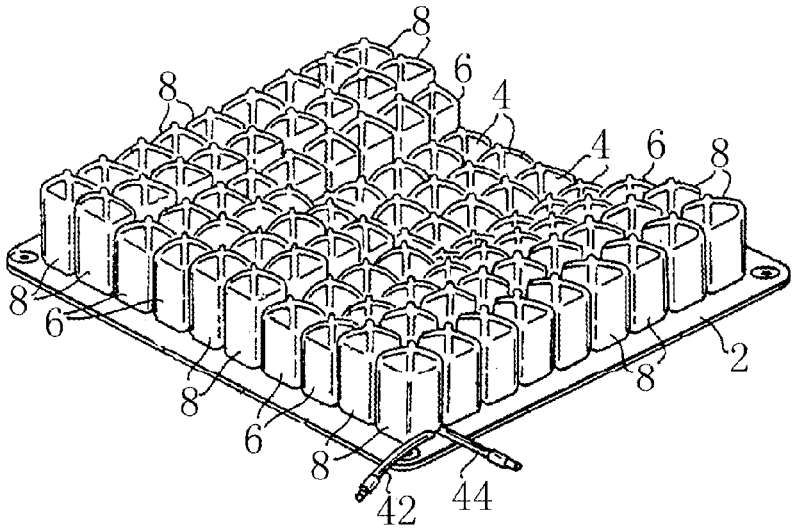
FIG. 1A (Prior Art)
FIG. 1A is a three-dimensional schematic view of a cushion in the prior art.
Figure 1B:
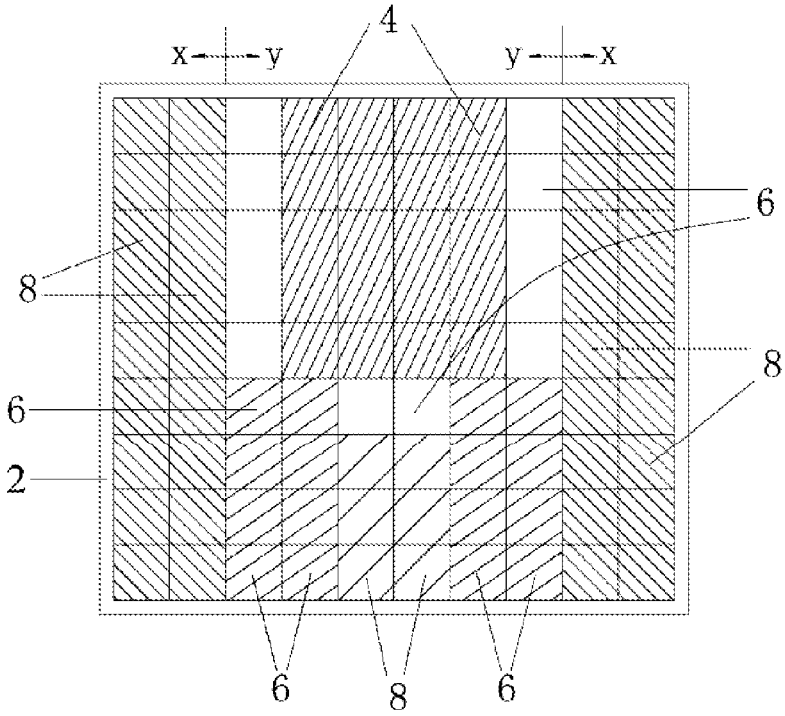
FIG. 1B (Prior Art)
FIG. 1B is a schematic view of distribution of air cell zones of the cushion shown in FIG. 1A.
Figure 2A:
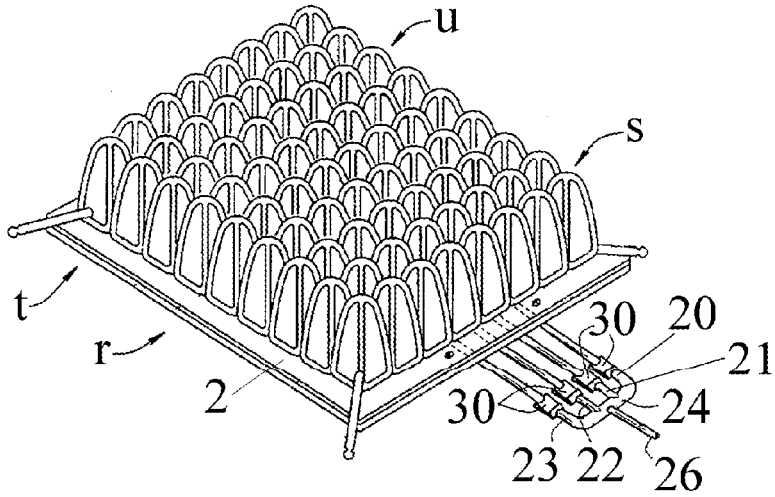
FIG. 2A (Prior Art)
FIG. 2A is a three-dimensional schematic view of another cushion in the prior art.
Figure 2B:
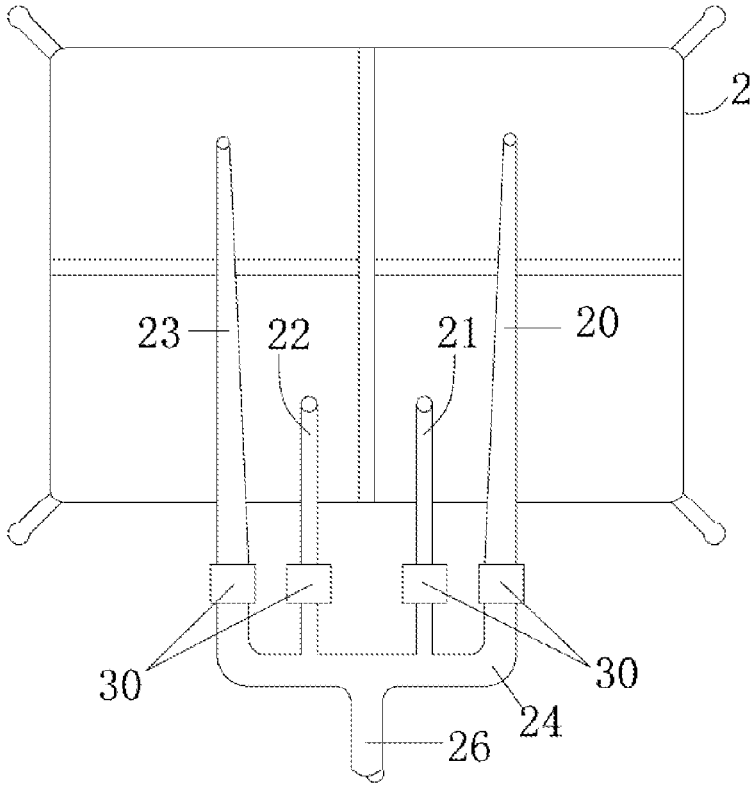
FIG. 2B (Prior Art)
FIG. 2B is a schematic view of distribution of air cell zones of the cushion shown in FIG. 2A.

The technical solution employed in the present invention to achieve the objective is further illustrated in the following with reference to the accompanying drawings and embodiments of the present invention.

The present invention provides a cushion for preventing pressure sore, which includes:

an air cell layer having a plurality of air cells and being divided into at least four air cell zones, air cells in each air cell zone being in communication with each other, but air cells in any two adjacent air cell zones being not in communication with each other;

an air passage layer located under the air cell layer and having a plurality of air passages therein, each air passage being in connection and communication with at least one of the air cell zones;

a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve.

In addition, the number of the air passages is less than the number of the air cell zones.

In the first embodiment of the present invention, the air cells in the air cell layer are sequentially organized clockwise into four air cell zones with equal areas, namely, an A air cell zone, a B air cell zone, a C air cell zone, and a D air cell zone; the air passage layer has two air passages therein, namely, a first air passage and a second air passage; the first air passage is in connection and communication with the A air cell zone and the C air cell zone, and the second air passage is in connection and communication with the B air cell zone and the D air cell zone. Definitely, in this embodiment, the air cells in the air cell layer are organized into four air cell zones with equal areas, but in other embodiments, the organization can be adjusted according to requirements, for example, the areas of air cell zones are not equal.

In the second embodiment of the present invention, the air cells in the air cell layer are organized into an A air cell zone, a B air cell zone, a C air cell zone, a D air cell zone, and an E air cell zone; the air passage layer has a first air passage, a second air passage, and a third air passage therein; the first air passage is in connection and communication with the A air cell zone and the C air cell zone, the second air passage is in connection and communication with the B air cell zone and the D air cell zone, and the third air passage is in connection and communication with the E air cell zone.

In the third embodiment of the present invention, the air cells in the air cell layer are organized into an A1 air cell zone, an A2 air cell zone, an A3 air cell zone, an A4 air cell zone, a B1 air cell zone, a B2 air cell zone, a B3 air cell zone, a B4 air cell zone, a C air cell zone, a D air cell zone, and an E air cell zone; the air passage layer has a first air passage, a second air passage, a third air passage, a fourth air passage, and a fifth air passage therein; the first air passage is in connection and communication with the A1, A2, A3, and A4 air cell zones, the second air passage is in connection and communication with the B1, B2, B3, and B4 air cell zones, the third air passage is in connection and communication with the C air cell zone, the fourth air passage is in connection and communication with the D air cell zone, and the fifth air passage is in connection and communication with the E air cell zone.

In the fourth embodiment of the present invention, the air cells in the air cell layer are organized into an A1 air cell zone, an A2 air cell zone, an A3 air cell zone, a B1 air cell zone, a B2 air cell zone, a B3 air cell zone, a C air cell zone, a D air cell zone, an E air cell zone, and an F air cell zone; the air passage layer has a first air passage, a second air passage, a third air passage, a fourth air passage, a fifth air passage, and a sixth air passage therein; the first air passage is in connection and communication with the A1, A2, and A3 air cell zones, the second air passage is in connection and communication with the B1, B2, and B3 air cell zones, the third air passage is in connection and communication with the C air cell zone, the fourth air passage is in connection and communication with the D air cell zone, the fifth air passage is in connection and communication with the E air cell zone, and the sixth air passage is in connection and communication with the F air cell zone.

In the fifth embodiment of the present invention, the air cells in the air cell layer are organized into an A1 air cell zone, an A2 air cell zone, an A3 air cell zone, an A4 air cell zone, an A5 air cell zone, a B1 air cell zone, a B2 air cell zone, a B3 air cell zone, a B4 air cell zone, a B5 air cell zone, and a C air cell zone; the air passage layer has a first air passage, a second air passage, and a third air passage therein; the first air passage is in connection and communication with the A1, A2, A3, A4, and A5 air cell zones, the second air passage is in connection and communication with the B1, B2, B3, B4, and B5 air cell zones, and the third air passage is in connection and communication with the C air cell zone.

In the above embodiments, the plurality of air ducts is disposed in the air passage layer or in the base layer.

In addition, the cushion for preventing pressure sore further includes an inflating device and a deflating device; the inflating device and the deflating device are connected to the joint of the air ducts. In practical implementation, the inflating device may be a manual inflating device (such as an inflator), and may also be a controlled electric inflating device (such as an air pump); the deflating device may be a manual deflating device (such as a deflator), or may be a controlled electric deflating device (such as an air pump).

Further, the cushion for preventing pressure sore may also include a control device; the control device is electrically connected to the valve on the air duct, and is electrically connected to the inflating device and the deflating device, so as to control the inflating device to inflate the air duct or control the deflating device to deflate the air duct. In addition, in an alternative embodiment, the cushion for preventing pressure sore may not include a deflating device, but controls the opening of the valve to slowly deflect the air duct.

Those skilled in the art can understand that the above valve may be a manual valve so as to fit the manual inflating device, or the above valve is a controlled electric valve so as to be electrically connected to the control device and fit the use of the electric inflating device. Definitely, those skilled in the art can understand that the manual valve can fit the use of the electric inflating device, or the electric valve can also fit the use of the manual inflating device.

In the above embodiments, each air cell is a columnar air cell; the columnar air cell includes a columnar outer casing layer and an air cell column disposed in the outer casing layer; the outer casing layer is made of the same material and is integrally formed; the wall thickness of the outer casing layer is kept the same from the bottom to the top. The air cell column is directly formed by foaming a sponge. Besides, a hydrogel layer is disposed at the top of the air cell column, and the hydrogel layer is directly formed at the top of the air cell column with excellent fitting and adhering performance. Air is filled in space among the outer casing layer, the air cell column, and the sealing layer, and is exchanged with gas inside the air cell, so as to control the humidity and temperature of the air cell. A sealing layer is disposed between the top of the air cell column and the hydrogel layer. The sealing layer tightly contacts an inner wall of the outer casing layer. The sealing layer is made of the same material as the outer casing layer; the sealing layer in tight contact with the inner wall of the outer casing layer may be formed after a secondary vulcanization process, thereby ensuring the tightness, firmness and beauty of the hydrogel layer.

The description in the background indicates that when being used by those who need to keep a sitting posture for a long time, the existing cushions can provide very comfortable sitting position and experience, but still continuously apply pressure to the body, and therefore are still very likely to trigger pressure sores.

The present invention is aimed at solving the problem that the cushions in the prior art cannot intermittently exert pressure over buttocks, and preventing blood circulation of skin from being blocked. Specific embodiments of the present invention are described in further details below with reference to the accompanying drawings.

Figure 3:
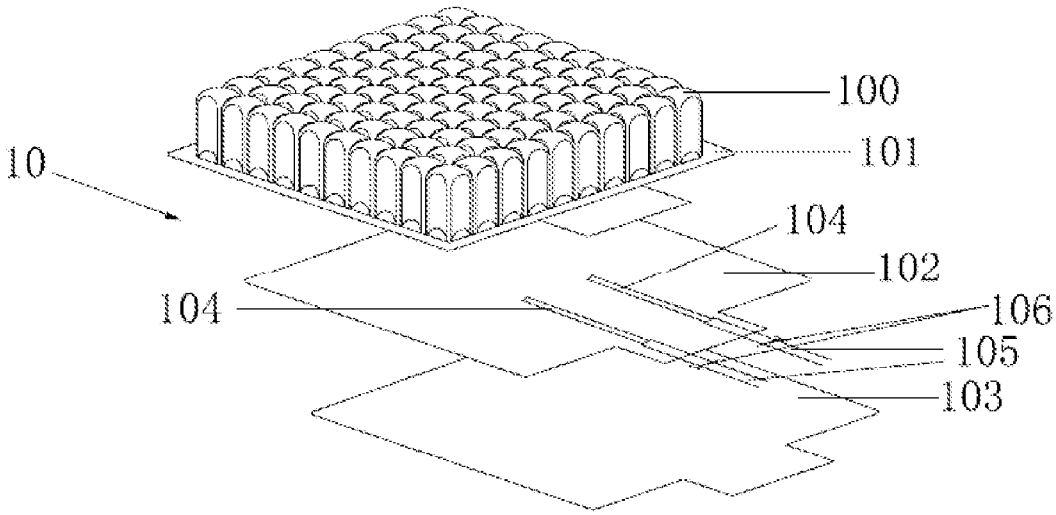
FIG. 3 is a three-dimensional exploded schematic view of the present invention.

FIG. 3 is a three-dimensional exploded schematic view of the present invention. As shown in FIG. 3, a cushion for preventing pressure sore 10 includes an air cell layer 101, an air passage layer 102, and a base layer 103 arranged sequentially from top down. The air passage layer 102 and the air cell layer 101 are disposed on the base layer 103. The cushion for preventing pressure sore 10 further includes a plurality of air ducts 105 and air passages 104. The air cell layer 101 has a plurality of air cells 100; in the figure, the air cells form a 10×10 air cell array, which, of course, is merely a schematic representation; in actual applications, the air cells may also form a 10×15 array, a 15×15 array, a 15×20 array, or a 20×20 array, and the like.

Figure 4:
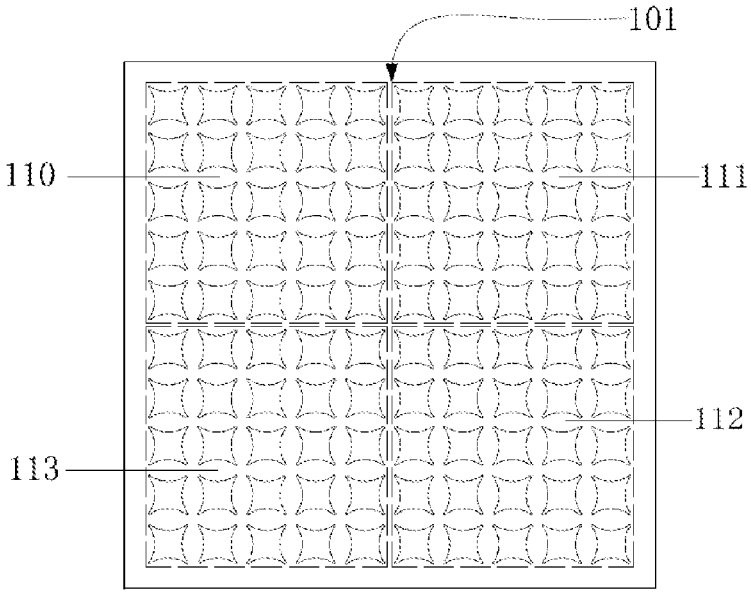
FIG. 4 is a schematic view of distribution of air cell zones according to a first embodiment of the present invention.

FIG. 4 is a schematic view of distribution of air cell zones according to a first embodiment of the present invention. As shown in FIG. 4, the air cell layer 101 are divided into four air cell zones with equal areas, namely, an A air cell zone 110, a B air cell zone 111, a C air cell zone 112, and a D air cell zone 113; air cells in each air cell zone are in communication with each other, but air cells in any two adjacent air cell zones are not in communication with each other; the air passage layer 102 has a first air passage and a second air passage. The first air passage is connected to the A air cell zone 110 and the C air cell zone 112; the second air passage is connected to the B air cell zone 111 and the D air cell zone 113. As shown in FIG. 3, an end of the air duct 105 is in communication with the corresponding first air passage and second air passage, and the other end extends out of the cushion and is provided with a joint; and each air duct 105 has a respective valve 106. In this embodiment, the air ducts 105 are disposed in the air passage layer 102; however, the air ducts 105 may also be disposed in the base layer 103.

Figure 5:
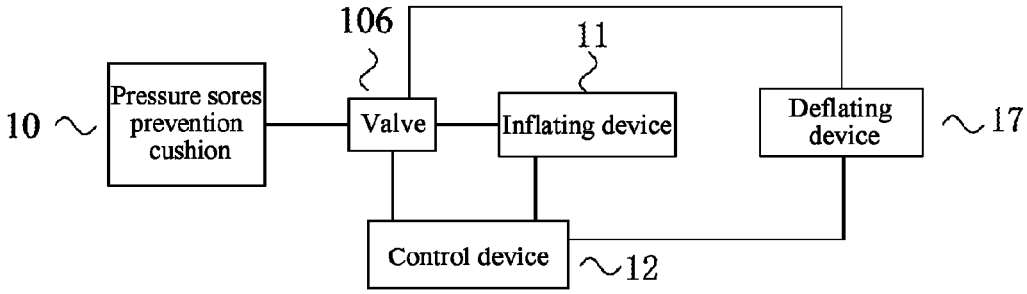
FIG. 5 is a schematic view about connection of a control device in the present invention.

As shown in FIG. 5, the cushion for preventing pressure sore 10 further includes an inflating device 11 and a deflating device 17. The inflating device 11 and the deflating device 17 are connected to the joint of the air ducts 105, and are connected to the valve 106. The cushion for preventing pressure sore 10 further includes a control device 12; the control device 12 is electrically connected to the valve 106 on the air duct 105, and is electrically connected to the inflating device 11 and the deflating device 17, so as to control the inflating device 11 to inflate the air duct 105 or control the deflating device 17 to deflate the air duct 105. In other words, the control device 12 can control the valve 106 and the inflating device 11, thereby inflating or deflating different air cell zones. For example, under the control of the control device, the A air cell zone and C air cell zone are inflated so as to maintain high pressure, and meanwhile the B air cell zone and D air cell zone are deflated so as to maintain low pressure; such a state lasts, for example, 1-10 minutes (the specific time is set according to an actual requirement), and then under the control of the control device, the B air cell zone and D air cell zone are inflated so as to maintain high pressure, and meanwhile the A air cell zone and C air cell zone are deflated so as to maintain low pressure; such a state lasts, for example, 1-10 minutes, and then the A air cell zone and C air cell zone are inflated so as to maintain high pressure, and meanwhile the B air cell zone and D air cell zone are deflated so as to maintain low pressure. The different air cell zones are pressurized in an alternating manner as described so that the pressure is applied in an alternating manner on different parts of buttocks of a person who sits on the cushion for a long time, thereby preventing continuously applying pressure to some part of the body and reducing the occurrence probability of pressure sores.

The above control device is a common control device to a person skilled in the art, and can be implemented by programming programmable control chips and using a necessary circuit board in coordination, which is a common technical means to a person skilled in the art and is not elaborated herein again.

Figure 6:
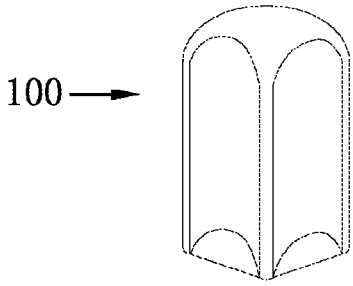
FIG. 6 is an enlarged three-dimensional schematic view of a columnar air cell in the present invention.
Figure 7:
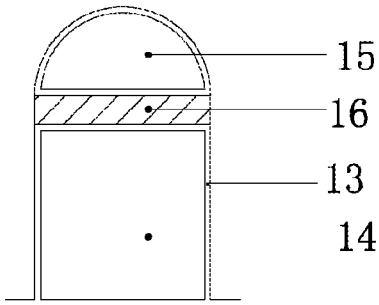
FIG. 7 is an enlarged profile view of a columnar air cell in the present invention.

Further, referring to FIG. 6 and FIG. 7, each air cell in the air cell layer 101 is a columnar air cell 100, and the columnar air cells 100 can have the same or different lengths. The columnar air cell 100 includes a columnar outer casing layer 13 and an air cell column 14 disposed in the outer casing layer 13; the outer casing layer 13 is made of the same material, and is integrally formed. The wall thickness of the outer casing layer 13 is kept the same from the bottom to the top. The air cell column 14 is directly formed by foaming a sponge, is highly fitting and firm, and meanwhile improves the overall stability of the air cell and helps maintain the shape of the air cell. Moreover, a hydrogel layer 15 is disposed at the top of the air cell column 14. The hydrogel layer 15 is directly formed at the top of the air cell column 14, and has excellent fitting and adhering performance. A high-water-content and constant-temperature phase transition material in the hydrogel provides a lasting cool feel. Air is filled in space among the outer casing layer 13, the air cell column 14, and the sealing layer 16, and is exchanged with gas in the air cell so as to control the humidity and temperature of the air cell.

The top of the outer casing layer 13 is an upwardly protruding cambered surface, which reduces edges and corners and increases a contact area. When the body contacts the arc-shaped hydrogel layer 15 at the top, no discomfort or pains is aroused.

A sealing layer 16 is disposed between the top of the air cell column 14 and the hydrogel layer 15. The sealing layer 16 tightly contacts an inner wall of the outer casing layer 13. The sealing layer 16 may be made of the same material as the outer casing layer 13; the sealing layer 16 in tight contact with the inner wall of the outer casing layer 13 may be formed after a secondary vulcanization process, thereby ensuring the tightness, firmness and beauty of the hydrogel layer 15, so that the directly formed hydrogel does not fall off or leak under the effect of gravity and extrusion of a body.

Figure 8:
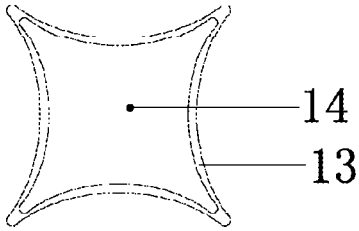
FIG. 8 is an enlarged cross sectional view of a columnar air cell in the present invention.
Figure 9:
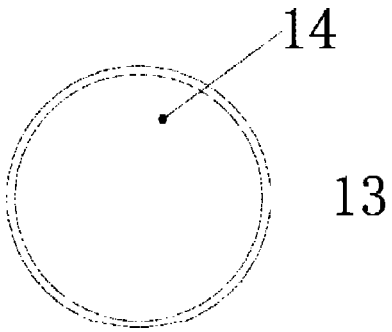
FIG. 9 is an enlarged cross sectional view of a first variant structure of a columnar air cell in the present invention.
Figure 10:
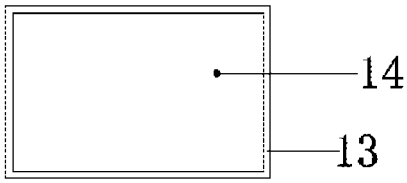
FIG. 10 is an enlarged cross sectional view of a second variant structure of a columnar air cell in the present invention.

As shown in FIG. 8 to FIG. 10, the cross section of the columnar air cell 100 is shaped into a four-pointed star, a cylinder or a cuboid. A person skilled in the art should know that the cross section of the columnar air cell 100 is not limited to the above three shapes, and may also be shaped into an ellipse, a triangle, a five-pointed star, and so on.

Figure 11:
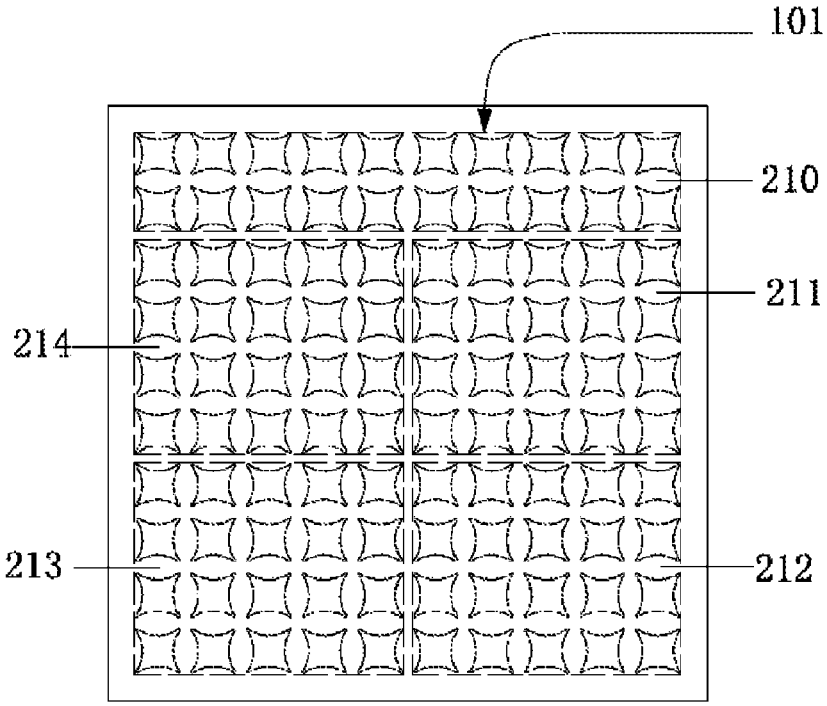
FIG. 11 is a schematic view of distribution of air cell zones according to a second embodiment of the present invention.

FIG. 11 is a schematic view of distribution of air cell zones according to a second embodiment of the present invention. According to FIG. 11 and the array below, the air cells in the air cell layer 101 are organized into an E air cell zone 210, a B2 air cell zone 11, a C air cell zone 212, a D air cell zone 213, and an A2 air cell zone 14. In FIG. 11, still, a 10×10 array formed of air cells is corresponding to the array below. However, a person skilled in the art can understand that the array below may also represent arrays formed of other quantities of air cells. In addition, the air passage layer 102 has a first air passage, a second air passage, and a third air passage; the first air passage is in connection and communication with the C air cell zone 212 and A2 air cell zone 14, the second air passage is in connection and communication with the B2 air cell zone 11 and D air cell zone 213, and the third air passage is in connection and communication with the E air cell zone 210.

$$\begin{bmatrix} E & E & E & E & E & E & E & E & E & E \\ E & E & E & E & E & E & E & E & E & E \\ A & A & A & A & A & B & B & B & B & B \\ A & A & A & A & A & B & B & B & B & B \\ A & A & A & A & A & B & B & B & B & B \\ A & A & A & A & A & B & B & B & B & B \\ D & D & D & D & D & C & C & C & C & C \\ D & D & D & D & D & C & C & C & C & C \\ D & D & D & D & D & C & C & C & C & C \\ D & D & D & D & D & C & C & C & C & C \end{bmatrix}$$

Further, in this embodiment, the cushion for preventing pressure sore also has air ducts, valves, an inflating device, a deflating device, and a control device, and the connection manner thereof is similar to that of the first embodiment, so that the control device can control the valve, inflating device and deflating device, thereby inflating or deflating different air cell zones. For example, under the control of the control device, the A air cell zone and C air cell zone are inflated so as to maintain high pressure, and meanwhile the B air cell zone and D air cell zone are deflated so as to maintain low pressure; such a state lasts, for example, 1-10 minutes; then, under the control of the control device, the B air cell zone and D air cell zone are inflated so as to maintain high pressure, and meanwhile the A air cell zone and C air cell zone are deflated so as to maintain low pressure; such a state lasts, for example, 1-10 minutes; then again, the A air cell zone and C air cell zone are inflated so as to maintain high pressure, and meanwhile the B air cell zone and D air cell zone are deflated so as to maintain low pressure. When the cushion is used, the E air cell zone is located under and contacts the thighs of the human body, and under the control of the control device, the E air cell zone may be inflated or deflated separately with an inflating or deflating frequency and pressure different from other air cell zones; alternatively, once being inflated, the E air cell zone maintains constant pressure. The inflating and deflating frequencies and the inflating and deflating pressure of the air cell zones can be adjusted for different patients; for instance, a patient can set the inflating or deflating pressure and time according to his moving ability and weight. The different air cell zones are inflated or deflated in an alternating manner as described so that the pressure is applied in an alternating manner on different parts of buttocks of a person who sits on the cushion for a long time, thereby preventing continuously applying pressure to some part of the body and reducing the occurrence probability of pressure sores.

Figure 12:
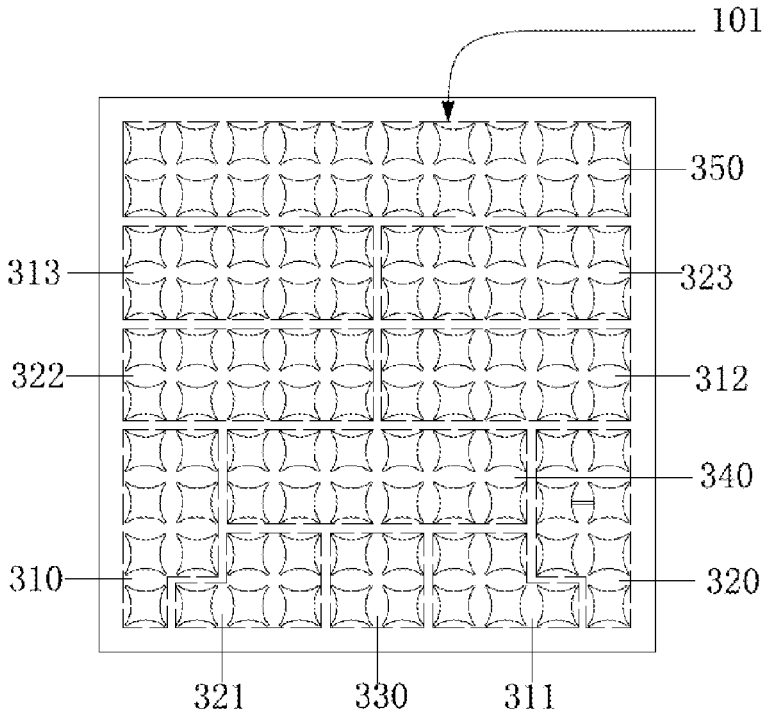
FIG. 12 is a schematic view of distribution of air cell zones according to a third embodiment of the present invention.

FIG. 12 is a schematic view of distribution of air cell zones according to a third embodiment of the present invention. According to FIG. 12 and the array below, the air cells in the air cell layer 101 are organized into an A1 air cell zone 310, an A2 air cell zone 311, an A3 air cell zone 312, an A4 air cell zone 313, a B1 air cell zone 320, a B2 air cell zone 321, a B3 air cell zone 322, a B4 air cell zone 323, a C air cell zone 330, a D air cell zone 340, and an E air cell zone 350. In FIG. 12, still, a 10×10 array formed of air cells is corresponding to the array below. However, a person skilled in the art can understand that the array below may also represent arrays formed of other quantities of air cells. In addition, the air passage layer 102 has a first air passage, a second air passage, a third air passage, a fourth air passage, and a fifth air passage therein. The first air passage is in connection and communication with the A1 air cell zone 310, A2 air cell zone 311, A3 air cell zone 312, and A4 air cell zone 313; the second air passage is in connection and communication with the B1 air cell zone 320, B2 air cell zone 321, B3 air cell zone 322, and B4 air cell zone 323; the third air passage is in connection and communication with the C air cell zone 330; the fourth air passage is in connection and communication with the D air cell zone 340; and the fifth air passage is in connection and communication with the E air cell zone 350.

$$\begin{bmatrix} E & E & E & E & E & E & E & E & E & E \\ E & E & E & E & E & E & E & E & E & E \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & B3 & A3 & A3 & A3 & A3 & A3 \\ B3 & B3 & B3 & B3 & B3 & A3 & A3 & A3 & A3 & A3 \\ A1 & A1 & D & D & D & D & D & D & B1 & B1 \\ A1 & A1 & D & D & D & D & D & D & B1 & B1 \\ A1 & A1 & B2 & B2 & C & C & A2 & A2 & B1 & B1 \\ A1 & B2 & B2 & B2 & C & C & A2 & A2 & A2 & B1 \end{bmatrix}$$

Further, in this embodiment, the cushion for preventing pressure sore also has air ducts, valves, an inflating device, a deflating device, and a control device, and the connection manner thereof is similar to that of the first embodiment, so that the control device can control the valve, inflating device and deflating device, thereby inflating or deflating different air cell zones. For example, under the control of the control device, the A1 air cell zone, A2 air cell zone, A3 air cell zone, and A4 air cell zone are inflated so as to maintain high pressure, and meanwhile the B1 air cell zone, B2 air cell zone, B3 air cell zone, and B4 air cell zone are deflated so as to maintain low pressure; such a state lasts, for example, 1-10 minutes; then, the A1 air cell zone, A2 air cell zone, A3 air cell zone, and A4 air cell zone are deflated so as to maintain low pressure, and meanwhile the B1 air cell zone, B2 air cell zone, B3 air cell zone, and B4 air cell zone are inflated so as to maintain high pressure; inflating and deflating are performed in such an alternating manner. At the same time, the control device also inflates and deflates the C air cell zone, D air cell zone, and E air cell zone with respective frequencies, so as to fit the inflating and deflating of the A1 air cell zone, A2 air cell zone, A3 air cell zone, A4 air cell zone, B1 air cell zone, B2 air cell zone, B3 air cell zone, and B4 air cell zone. The inflating and deflating frequencies and pressure of the C air cell zone, D air cell zone and E air cell zone may be the same or different, which can be adjusted by a user who actually uses the cushion. Moreover, once being inflated, the E air cell zone maintains constant pressure, which is not changed any more. In addition, the duration of the inflating and deflating may be selectively adjusted according to parameters such as an inflating or deflating speed, a required gas volume, and intensity of pressure. The air cell zones are inflated and deflated frequently in an alternating manner, so that the pressure of different air cell zones is frequently changed, and the pressure is applied in an alternating manner on different parts of buttocks of a person who sits on the cushion for a long time, thereby preventing continuously applying pressure to some part of the body and reducing the occurrence probability of pressure sores.

Figure 13:
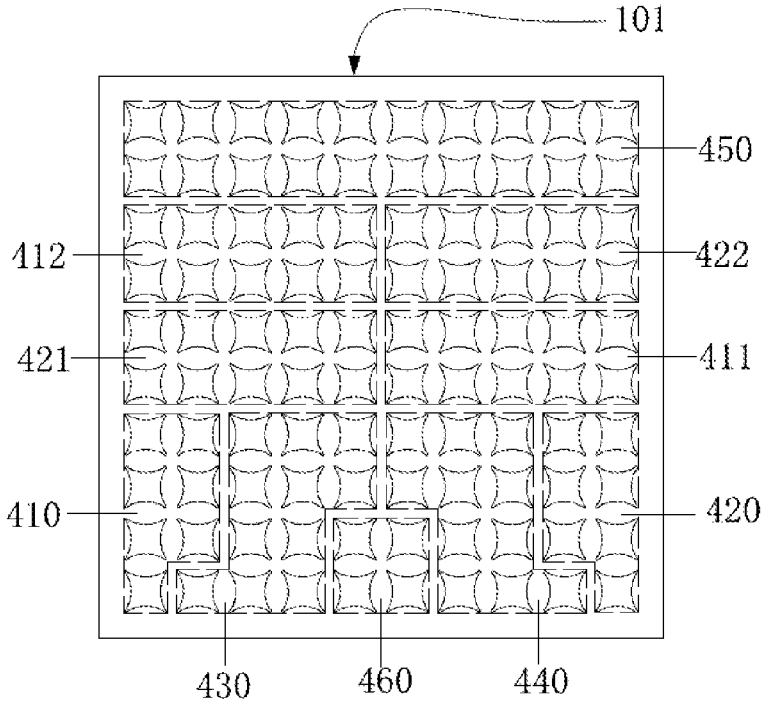
FIG. 13 is a schematic view of distribution of air cell zones according to a fourth embodiment of the present invention.

FIG. 13 is a schematic view of distribution of air cell zones according to a fourth embodiment of the present invention. According to FIG. 13 and the array below, the air cells in the air cell layer 101 are organized into an A1 air cell zone 410, an A2 air cell zone 411, an A3 air cell zone 412, a B1 air cell zone 420, a B2 air cell zone 421, a B3 air cell zone 422, a C air cell zone 430, a D air cell zone 440, an E air cell zone 450, and an F air cell zone 460. In FIG. 13, still, a 10×10 array formed of air cells is corresponding to the array below. However, a person skilled in the art can understand that the array below may also represent arrays formed of other quantities of air cells. In addition, the air passage layer 102 has a first air passage, a second air passage, a third air passage, a fourth air passage, a fifth air passage, and a sixth air passage therein; the first air passage is in connection and communication with the A1 air cell zone 410, A2 air cell zone 411, and A3 air cell zone 412; the second air passage is in connection and communication with the B1 air cell zone 420, B2 air cell zone 421, and B3 air cell zone 422; the third air passage is in connection and communication with the C air cell zone 430; the fourth air passage is in connection and communication with the D air cell zone 440, the fifth air passage is in connection and communication with the E air cell zone 450; and the sixth air passage is in connection and communication with the F air cell zone 460.

$$\begin{bmatrix} E & E & E & E & E & E & E & E & E & E \\ E & E & E & E & E & E & E & E & E & E \\ A3 & A3 & A3 & A3 & A3 & B3 & B3 & B3 & B3 & B3 \\ A3 & A3 & A3 & A3 & A3 & B3 & B3 & B3 & B3 & B3 \\ B2 & B2 & B2 & B2 & B2 & A2 & A2 & A2 & A2 & A2 \\ B2 & B2 & B2 & B2 & B2 & A2 & A2 & A2 & A2 & A2 \\ A1 & A1 & C & C & C & D & D & D & B1 & B1 \\ A1 & A1 & C & C & C & D & D & D & B1 & B1 \\ A1 & A1 & C & C & F & F & D & D & B1 & B1 \\ A1 & C & C & C & F & F & D & D & D & B1 \end{bmatrix}$$

Further, in this embodiment, the cushion for preventing pressure sore also has air ducts, valves, an inflating device, a deflating device, and a control device, and the connection manner thereof is similar to that of the first embodiment, so that the control device can control the valve, inflating device and deflating device, thereby inflating or deflating different air cell zones. For example, under the control of the control device, the A1 air cell zone, A2 air cell zone, A3 air cell zone are inflated so as to maintain high pressure, and meanwhile the B1 air cell zone, B2 air cell zone, B3 air cell zone are deflated so as to maintain low pressure; such a state lasts, for example, 1-10 minutes; then, the A1 air cell zone, A2 air cell zone, and A3 air cell zone are deflated so as to maintain low pressure, and meanwhile the B1 air cell zone, B2 air cell zone, and B3 air cell zone are inflated so as to maintain high pressure; such a state lasts, for example, 1-10 minutes; inflating and deflating are performed in such an alternating manner. At the same time, the control device further inflates and deflates the C air cell zone, D air cell zone, E air cell zone, and F air cell zone with respective frequencies, so as to fit the inflating and deflating of the A1 air cell zone, A2 air cell zone, A3 air cell zone, B1 air cell zone, B2 air cell zone, and B3 air cell zone. The same as the third embodiment, the inflating and deflating frequencies and pressure of the C air cell zone, D air cell zone, E air cell zone, and F air cell zone can also be adjusted in this embodiment. Moreover, once being inflated, the E air cell zone maintains constant pressure, which is not changed any more. The pressure of different air cell zones frequently changes, so that the pressure is in an alternating manner applied on different parts of buttocks of a person who sits on the cushion for a long time, thereby preventing continuously applying pressure to some part of the body and reducing the occurrence probability of pressure sores.

Figure 14:
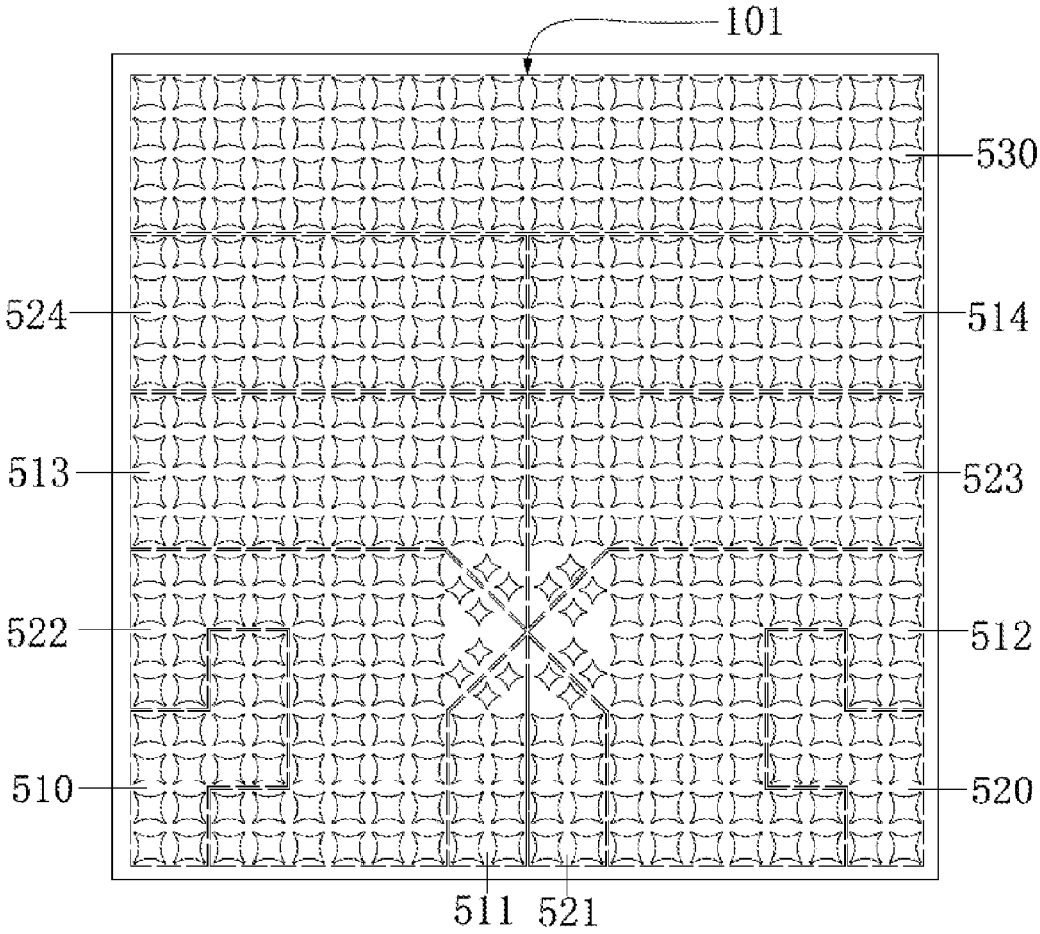
FIG. 14 is a schematic view of distribution of air cell zones according to a fifth embodiment of the present invention.

FIG. 14 is a schematic view of distribution of air cell zones according to a fifth embodiment of the present invention. According to FIG. 14 and the array below, the air cells in the air cell layer 101 are organized into an A1 air cell zone 510, an A2 air cell zone 511, an A3 air cell zone 512, an A4 air cell zone 513, an A5 air cell zone 514, a B1 air cell zone 520, a B2 air cell zone 521, a B3 air cell zone 522, a B4 air cell zone 523, a B5 air cell zone 524, and a C air cell zone 530. In FIG. 14, a 20×20 array formed of air cells is corresponding to the array below, which is different from the 10×10 air cell array used in other embodiments. In other embodiments, one letter position in the array directly corresponds to an air cell, while in this embodiment one letter position in the array below corresponds to four air cells, hence forming a 20×20 air cell array. Definitely, this is merely a schematic representation, and a person skilled in the art may also make one letter position in the array below correspond to other quantities of air cells, for example, three air cells, five air cells, nine air cells, and so on. Therefore, in other embodiments, although a 10×10 array formed of air cells is taken as an example for graphical representation, but it can be understood that a 20×20 array formed of air cells, or arrays formed of other quantities of air cells can also be used for graphical representation. In addition, the air passage layer 102 has a first air passage, a second air passage, and a third air passage; the first air passage is in connection and communication with the A1 air cell zone 510, A2 air cell zone 511, A3 air cell zone 512, A4 air cell zone 513, and A5 air cell zone 514; the second air passage is in connection and communication with the B1 air cell zone 520, B2 air cell zone 521, B3 air cell zone 522, B4 air cell zone 523, and B5 air cell zone 524; and the third air passage is in connection and communication with the C air cell zone 530.

$$\begin{bmatrix} C & C & C & C & C & C & C & C & C & C \\ C & C & C & C & C & C & C & C & C & C \\ B5 & B5 & B5 & B5 & B5 & A5 & A5 & A5 & A5 & A5 \\ B5 & B5 & B5 & B5 & B5 & A5 & A5 & A5 & A5 & A5 \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & {}_{B3}\backslash^{A4} & {}^{B4}/_{A3} & A3 & A3 & A3 & A3 \\ B3 & A1 & B3 & B3 & {}^{B3}/_{A2} & {}_{B2}\backslash^{A3} & A3 & A3 & B1 & A3 \\ A1 & A1 & B3 & B3 & A2 & B2 & A3 & A3 & B1 & B1 \\ A1 & B3 & B3 & B3 & A2 & B2 & A3 & A3 & A3 & B1 \end{bmatrix}$$

Further, in this embodiment, the cushion for preventing pressure sore also has air ducts, valves, an inflating device, a deflating device, and a control device, and the connection manner thereof is similar to that of the first embodiment, so that the control device can control the valve, inflating device and deflating device, thereby inflating or deflating different air cell zones. For example, under the control of the control device, the A1 air cell zone, A2 air cell zone, A3 air cell zone, A4 air cell zone, A5 air cell zone are inflated so as to maintain high pressure, and meanwhile the B1 air cell zone, B2 air cell zone, B3 air cell zone, B4 air cell zone, B5 air cell zone are deflated so as to maintain low pressure; such a state lasts, for example, 1-10 minutes; then, the A1 air cell zone, A2 air cell zone, A3 air cell zone, A4 air cell zone, and A5 air cell zone are deflated so as to maintain low pressure, and meanwhile the B1 air cell zone, B2 air cell zone, B3 air cell zone, B4 air cell zone, and B5 air cell zone are inflated so as to maintain high pressure; such a state lasts, for example, 1-10 minutes; inflating and deflating are performed in such an alternating manner. At the same time, the control device further inflates and deflates the C air cell zone at a certain frequency, so as to fit the inflating and deflating of the A1 air cell zone, A2 air cell zone, A3 air cell zone, A4 air cell zone, A5 air cell zone, B1 air cell zone, B2 air cell zone, B3 air cell zone, B4 air cell zone, and B5 air cell zone. Alternatively, once being inflated, the C air cell zone maintains a constant pressure, which is not changed any more. The pressure of different air cell zones frequently changes, so that the pressure is applied in an alternating manner on different parts of buttocks of a person who sits on the cushion for a long time, thereby preventing continuously applying pressure to some part of the body and reducing the occurrence probability of pressure sores. The inflating and deflating frequencies and the inflating and deflating pressure of the air cell zones can be adjusted for different patients; for instance, a patient can set the inflating or deflating pressure and time according to his moving ability and weight.

The inflating and deflating states of different air cell zones in the above embodiments of the present invention are merely used to exemplarily describe the principle and efficacy of the present invention. The inflating and deflating frequencies or pressure of different air cell zones can be the same or different, and can be properly adjusted and varied in many feasible manners according to conditions of different users. In the above embodiments of the present invention, the connection manner among the plurality of air cells in the air cell zone is also diversified, and is not uniquely defined, as long as air cells are communicated to let gas through in each air cell zone.

The present invention can effectively prevent the occurrence of pressure sores. As a use example, during a use process, when body buttocks sit on the cushion for preventing pressure sore, different air cell zones are inflated and deflated according to a requirement, and the pressure and pressure lasting time of different air cell zones are controlled, where the pressure and pressure lasting time are set according to conditions of patients, so that different parts of the buttocks are subject to same or different pressure within the same or different periods of time. With different parameters set for different body weights, the control device can control the inflating device and the valve to inflate or deflate the cushion for preventing pressure sore when the pressure exceeds the upper limit or drops below the lower limit. By means of the control device, different air cell zones can be inflated and deflated in an alternating manner. When the buttocks of a patient contact are in contact with the cushion for a long time, another device can be added to blow the air cell, so as to lower the temperature and humidity on the surface of the air cell.

The above embodiments are merely intended to exemplarily illustrate the principle and efficacy of the present invention, but the present invention is not limited to the above implementation manners. Those skilled in the art can make modifications to the embodiments without departing from the spirit and scope of the present invention and within the protection scope of the claims. Therefore, the protection scope of the present invention shall be subject to the appended claims.

What is claimed is:

1. A cushion for preventing pressure sore, comprising:

an air cell layer, having a plurality of air cells and being divided into at least four air cell zones, air cells in each air cell zone being in communication with each other, but air cells in any two adjacent air cell zones being not in communication with each other;

an air passage layer, located under the air cell layer and having a plurality of air passages therein, each air passage being connected to and in communication with at least one of the air cell zones;

a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve;

wherein the number of the air passages is less than the number of the air cell zones, and wherein the air cells in the air cell layer are organized into an A air cell zone, a B air cell zone, a C air cell zone, a D air cell zone, and an E air cell zone as arranged in an array below; the air passage layer has a first air passage, a second air passage, and a third air passage therein; the first air passage is in connection and communication with the A air cell zone and the C air cell zone, the second air passage is in connection and communication with the B air cell zone and the D air cell zone, and the third air passage is in connection and communication with the E air cell zone; the array is shown as follows:

$$\begin{bmatrix} E & E & E & E & E & E & E & E & E & E \\ E & E & E & E & E & E & E & E & E & E \\ A & A & A & A & A & B & B & B & B & B \\ A & A & A & A & A & B & B & B & B & B \\ A & A & A & A & A & B & B & B & B & B \\ A & A & A & A & A & B & B & B & B & B \\ D & D & D & D & D & C & C & C & C & C \\ D & D & D & D & D & C & C & C & C & C \\ D & D & D & D & D & C & C & C & C & C \\ D & D & D & D & D & C & C & C & C & C \end{bmatrix}.$$

2. The cushion for preventing pressure sore according to claim 1, wherein the plurality of air ducts is disposed in the air passage layer or in the base layer.

3. The cushion for preventing pressure sore according to claim 2, further comprising an inflating device and a deflating device, wherein the inflating device and deflating device are connected to the joint of the air ducts.

4. The cushion for preventing pressure sore according to claim 3, further comprising a control device, wherein the control device is electrically connected to the valve on the air duct, and is electrically connected to the inflating device and deflating device, so as to control the inflating device to inflate the air duct, or control the deflating device to deflate the air duct.

5. The cushion for preventing pressure sore according to claim 1, wherein each air cell in the air cell layer is a columnar air cell; the columnar air cell comprises a columnar outer casing layer and an air cell column disposed in the outer casing layer; a hydrogel layer is disposed at the top of the air cell column, a sealing layer is disposed between the top of the air cell column and the hydrogel layer, and air is filled in space among the outer casing layer, the air cell column, and the sealing layer.

6. A cushion for preventing pressure sore, comprising:

an air cell layer, having a plurality of air cells and being divided into at least four air cell zones, air cells in each air cell zone being in communication with each other, but air cells in any two adjacent air cell zones being not in communication with each other;

an air passage layer, located under the air cell layer and having a plurality of air passages therein, each air passage being connected to and in communication with at least one of the air cell zones;

a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve;

wherein the number of the air passages is less than the number of the air cell zones, and wherein the air cells in the air cell layer are organized into an A1 air cell zone, an A2 air cell zone, an A3 air cell zone, an A4 air cell zone, a B1 air cell zone, a B2 air cell zone, a B3 air cell zone, a B4 air cell zone, a C air cell zone, a D air cell zone and an E air cell zone as arranged in an array below; the air passage layer has a first air passage, a second air passage, a third air passage, a fourth air passage, and a fifth air passage therein; the first air passage is in connection and communication with the A1, A2, A3, and A4 air cell zones, the second air passage is in connection and communication with the B1, B2, B3, and B4 air cell zones, the third air passage is in connection and communication with the C air cell zone, the fourth air passage is in connection and communication with the D air cell zone, and the fifth air passage is in connection and communication with the E air cell zone; the array is shown as follows:

$$\begin{bmatrix} E & E & E & E & E & E & E & E & E & E \\ E & E & E & E & E & E & E & E & E & E \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & B3 & A3 & A3 & A3 & A3 & A3 \\ B3 & B3 & B3 & B3 & B3 & A3 & A3 & A3 & A3 & A3 \\ A1 & A1 & D & D & D & D & D & D & B1 & B1 \\ A1 & A1 & D & D & D & D & D & D & B1 & B1 \\ A1 & A1 & B2 & B2 & C & C & A2 & A2 & B1 & B1 \\ A1 & B2 & B2 & B2 & C & C & A2 & A2 & A2 & B1 \end{bmatrix}.$$

7. The cushion for preventing pressure sore according to claim 6, wherein the plurality of air ducts is disposed in the air passage layer or in the base layer.

8. The cushion for preventing pressure sore according to claim 7, further comprising an inflating device and a deflating device, wherein the inflating device and deflating device are connected to the joint of the air ducts.

9. The cushion for preventing pressure sore according to claim 8, further comprising a control device, wherein the control device is electrically connected to the valve on the air duct, and is electrically connected to the inflating device and deflating device, so as to control the inflating device to inflate the air duct, or control the deflating device to deflate the air duct.

10. The cushion for preventing pressure sore according to claim 6, wherein each air cell in the air cell layer is a columnar air cell; the columnar air cell comprises a columnar outer casing layer and an air cell column disposed in the outer casing layer; a hydrogel layer is disposed at the top of the air cell column, a sealing layer is disposed between the top of the air cell column and the hydrogel layer, and air is filled in space among the outer casing layer, the air cell column, and the sealing layer.

11. A cushion for preventing pressure sore, comprising:

an air cell layer, having a plurality of air cells and being divided into at least four air cell zones, air cells in each air cell zone being in communication with each other, but air cells in any two adjacent air cell zones being not in communication with each other;

an air passage layer, located under the air cell layer and having a plurality of air passages therein, each air passage being connected to and in communication with at least one of the air cell zones;

a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve;

wherein the number of the air passages is less than the number of the air cell zones, and wherein the air cells in the air cell layer are organized into an A1 air cell zone, an A2 air cell zone, an A3 air cell zone, a B1 air cell zone, a B2 air cell zone, a B3 air cell zone, a C air cell zone, a D air cell zone, an E air cell zone, and an F air cell zone as arranged in an array below; the air passage layer has a first air passage, a second air passage, a third air passage, a fourth air passage, a fifth air passage and a sixth air passage therein; the first air passage is in connection and communication with the A1, A2, and A3 air cell zones, the second air passage is in connection and communication with the B1, B2, and B3 air cell zones, the third air passage is in connection and communication with the C air cell zone, the fourth air passage is in connection and communication with the D air cell zone, the fifth air passage is in connection and communication with the E air cell zone, and the sixth air passage is in connection and communication with the F air cell zone; the array is shown as follows:

$$\begin{bmatrix} E & E & E & E & E & E & E & E & E & E \\ E & E & E & E & E & E & E & E & E & E \\ A3 & A3 & A3 & A3 & A3 & B3 & B3 & B3 & B3 & B3 \\ A3 & A3 & A3 & A3 & A3 & B3 & B3 & B3 & B3 & B3 \\ B2 & B2 & B2 & B2 & B2 & A2 & A2 & A2 & A2 & A2 \\ B2 & B2 & B2 & B2 & B2 & A2 & A2 & A2 & A2 & A2 \\ A1 & A1 & C & C & C & D & D & D & B1 & B1 \\ A1 & A1 & C & C & C & D & D & D & B1 & B1 \\ A1 & A1 & C & C & F & F & D & D & B1 & B1 \\ A1 & C & C & C & F & F & D & D & D & B1 \end{bmatrix}.$$

12. The cushion for preventing pressure sore according to claim 11, wherein the plurality of air ducts is disposed in the air passage layer or in the base layer.

13. The cushion for preventing pressure sore according to claim 12, further comprising an inflating device and a deflating device, wherein the inflating device and deflating device are connected to the joint of the air ducts.

14. The cushion for preventing pressure sore according to claim 13, further comprising a control device, wherein the control device is electrically connected to the valve on the air duct, and is electrically connected to the inflating device and deflating device, so as to control the inflating device to inflate the air duct, or control the deflating device to deflate the air duct.

15. The cushion for preventing pressure sore according to claim 11, wherein each air cell in the air cell layer is a columnar air cell; the columnar air cell comprises a columnar outer casing layer and an air cell column disposed in the outer casing layer; a hydrogel layer is disposed at the top of the air cell column, a sealing layer is disposed between the top of the air cell column and the hydrogel layer, and air is filled in space among the outer casing layer, the air cell column, and the sealing layer.

16. A cushion for preventing pressure sore, comprising:

an air cell layer, having a plurality of air cells and being divided into at least four air cell zones, air cells in each air cell zone being in communication with each other, but air cells in any two adjacent air cell zones being not in communication with each other;

an air passage layer, located under the air cell layer and having a plurality of air passages therein, each air passage being connected to and in communication with at least one of the air cell zones;

a base layer, the air passage layer and the air cell layer being disposed on the base layer; and a plurality of air ducts, an end of each air duct being in communication with a corresponding air passage, and the other end extending out of the cushion and being provided with a joint, and each air duct having a respective valve;

wherein the number of the air passages is less than the number of the air cell zones, and wherein the air cells in the air cell layer are organized into an A1 air cell zone, an A2 air cell zone, an A3 air cell zone, an A4 air cell zone, an A5 air cell zone, a B1 air cell zone, a B2 air cell zone, a B3 air cell zone, a B4 air cell zone, a B5 air cell zone, and a C air cell zone as arranged in an array below; the air passage layer has a first air passage, a second air passage, and a third air passage therein; the first air passage is in connection and communication with the A1, A2, A3, A4, and A5 air cell zones, the second air passage is in connection and communication with the B1, B2, B3, B4, and B5 air cell zones, and the third air passage is in connection and communication with the C air cell zone; the array is shown as follows:

$$\begin{bmatrix} C & C & C & C & C & C & C & C & C & C \\ C & C & C & C & C & C & C & C & C & C \\ B5 & B5 & B5 & B5 & B5 & A5 & A5 & A5 & A5 & A5 \\ B5 & B5 & B5 & B5 & B5 & A5 & A5 & A5 & A5 & A5 \\ A4 & A4 & A4 & A4 & A4 & B4 & B4 & B4 & B4 & B4 \\ A4 & A4 & A4 & A4 & A4 & B4 & B4 & B4 & B4 & B4 \\ B3 & B3 & B3 & B3 & {}_{B3}\backslash^{A4} & {}^{B4}/_{A3} & A3 & A3 & A3 & A3 \\ B3 & A1 & B3 & B3 & {}^{B3}/_{A2} & {}_{B2}\backslash^{A3} & A3 & A3 & B1 & A3 \\ A1 & A1 & B3 & B3 & A2 & B2 & A3 & A3 & B1 & B1 \\ A1 & B3 & B3 & B3 & A2 & B2 & A3 & A3 & A3 & B1 \end{bmatrix}.$$

17. The cushion for preventing pressure sore according to claim 16, wherein the plurality of air ducts is disposed in the air passage layer or in the base layer.

18. The cushion for preventing pressure sore according to claim 17, further comprising an inflating device and a deflating device, wherein the inflating device and deflating device are connected to the joint of the air ducts.

19. The cushion for preventing pressure sore according to claim 18, further comprising a control device, wherein the control device is electrically connected to the valve on the air duct, and is electrically connected to the inflating device and deflating device, so as to control the inflating device to inflate the air duct, or control the deflating device to deflate the air duct.

20. The cushion for preventing pressure sore according to claim 16, wherein each air cell in the air cell layer is a columnar air cell; the columnar air cell comprises a columnar outer casing layer and an air cell column disposed in the outer casing layer; a hydrogel layer is disposed at the top of the air cell column, a sealing layer is disposed between the top of the air cell column and the hydrogel layer, and air is filled in space among the outer casing layer, the air cell column, and the sealing layer.

* * * * *